United States Patent [19]

D'Angelo et al.

[11] Patent Number: 4,699,031

[45] Date of Patent: Oct. 13, 1987

[54] METHOD AND APPARATUS FOR AUTOMATICALLY CUTTING A WEB OF FOAM MATERIAL INTO SHEETS AND FOR DISPENSING THE CUT SHEETS

[75] Inventors: Joseph J. D'Angelo, Wycoff; Joseph J. D'Angelo, Jr., Pompton Lakes, both of N.J.

[73] Assignee: Ametek, Inc., New York, N.Y.

[21] Appl. No.: 831,184

[22] Filed: Feb. 20, 1986

[51] Int. Cl.[4] ..... B26D 7/02; B65H 35/00

[52] U.S. Cl. ..... 83/23; 83/39; 83/42; 83/26; 83/110; 83/155; 83/208; 83/261; 83/282; 226/155; 493/463

[58] Field of Search ..... 83/110, 155, 208, 261, 83/282, 23, 26, 39, 42; 226/155, 154; 493/463

[56] References Cited

U.S. PATENT DOCUMENTS

| | | | |
|---|---|---|---|
| 1,464,544 | 8/1923 | Sevigne et al. | 83/261 X |
| 3,715,944 | 2/1973 | Knechtel et al. | 83/208 X |
| 3,751,029 | 8/1973 | D'Angelo | 270/69 |
| 3,813,976 | 6/1974 | Greer | 83/282 X |
| 4,041,598 | 8/1977 | D'Angelo et al. | 29/432 |
| 4,151,770 | 5/1979 | D'Angelo et al. | 83/208 X |
| 4,205,573 | 6/1980 | D'Angelo et al. | 83/733 |
| 4,207,667 | 6/1980 | D'Angelo | 29/417 |
| 4,221,145 | 9/1980 | Shimizu et al. | 83/110 X |
| 4,253,892 | 3/1981 | D'Angelo et al. | 156/84 |
| 4,272,311 | 6/1981 | D'Angelo et al. | 156/215 |
| 4,429,602 | 2/1984 | Vitts | 83/261 X |
| 4,526,565 | 7/1985 | Hummel et al. | 493/463 |

*Primary Examiner*—Donald R. Schran

*Attorney, Agent, or Firm*—Ratner & Prestia

[57] ABSTRACT

A web of foam material is fed to a cutting station by upper and lower rollers drawing the web from a supply roll and along a low-friction table surface. A cutter station has a knife bar and blade, with a clamp bar coupled with the knife bar. The lower draw roller has its axle mounted in a pair of pivoted arms depressible by presser feet on a presser foot bar carried by the knife bar. When a desired length of web has been drawn past the cutter station, actuation of the knife bar lowers the blade toward a grooved anvil, while the presser feet swing the arms down to depress the lower roller away from the web to stop drawing it. Immediately after interrupting drawing action, the web is clamped by the clamp bar, and then immediately thereafter cutting occurs. The table has bridge-like fingers extending downstream through grooves in the movable lower feed roller. These fingers support the web when the lower roller is swung down. The cut sheets are conveyed through a static eliminator and then pass between staggered corrugation rolls for temporarily imparting longitudinal stiffness for enabling the temporarily corrugated sheet to be longitudinally projected through the air for dispensing into a desired position of utility, for example landing in the open top of a box packed with delicate items.

14 Claims, 9 Drawing Figures

METHOD AND APPARATUS FOR AUTOMATICALLY CUTTING A WEB OF FOAM MATERIAL INTO SHEETS AND FOR DISPENSING THE CUT SHEETS

BACKGROUND OF THE INVENTION

This invention relates to a method and apparatus for cutting a web of foam material into sheets of predetermined length and then dispensing such sheets in a manner permitting them to be used immediately in a packaging arrangement in which they are desired.

Foam material is widely used in packaging because of its large volume, light weight and the ability to absorb shocks experienced when packages are in transit. For many packaging applications it is desirable to employ the foam material in sheet form for lining containers or for separating layers of items in the containers and for resilient padding in the top of containers.

The foam sheet material because of its bulk, light weight and lack of structural strength is difficult to form into cut sheets and difficult to handle the cut sheets, particularly in an automatic environment. Because of the difficulties in cutting and handling sheet foam material, various packaging and shipping environments have in the past involved considerable amounts of hand labor. The foam material often has been delivered to the packager or shipper as pre-sut sheet stock delivered in packages. Premium payments must be made for the convenience of pre-cut and packaged sheet foam stock. Then, hand labor must be employed to take such pre-cut sheet from its package and to place the sheet into the container. In many applications where sheets of foam are applied to the top layer of a container, an operator must remove the pre-cut sheets from a box holding a plurality of such sheets which have been cut to a predetermined size and then to place the pre-cut foam sheets into the tops of the containers as padding for completely filling the containers before the containers are closed ready for shipment.

SUMMARY OF THE INVENTION

Accordingly, it is an object of this invention to provide a new and improved method and apparatus for automatically cutting a web of foam material into sheets of predetermined length and then for automatically dispensing the cut sheets directly into a desired position of utility, for example directly into shipping containers in a manner which is inexpensive, efficient and reliable.

A further object of this invention is to provide a new and improved method and apparatus for automatically cutting and dispensing sheets of foam material from a web which enables an operator to directly utilize the cut sheets as they are produced and dispensed.

Still another object of this invention is to provide a new and improved apparatus for automatically cutting and dispensing sheets of foam material which capably and reliably handles the foam material not only accurately to cut such material but also gently to handle the material while the transporting and cutting processes are taking place.

In carrying out this invention in one illustrative embodiment thereof, a method and apparatus are provided for automatically cutting a web of foam material into sheets of predetermined length and for dispensing those sheets by feeding a web of foam material from a supply roll to a cutting station via a low-friction surface on a table by sliding the web along that surface using upper and lower draw rollers which normally contact the web as it is being fed to a cutting station. After the proper length of sheet which is desired to be cut has passed by the cutting station, the lower draw roller is moved down away from the web thereby removing any drive action and immediately after the drive action is thus removed the web is clamped to the table while the web is being cut. Then, the lower draw roller is returned to its initial web-contacting position for feeding the next portion of the web, while the cut sheet is conveyed to and conveniently dispensed from the output of the apparatus. The cut sheet is passed through a static eliminator and then is passed between staggered corrugating rolls at the output of the apparatus for momentarily giving longitudinal stiffness to the temporarily corrugated sheet for enabling this sheet to be projected longitudinally through the air for dispensing to a desired position of utility, for example such as landing in the open top of a container packed with resilient items for padding them during subsequent shipment.

BRIEF DESCRIPTION OF THE DRAWINGS

The invention, together with further objects, features, aspects and advantages thereof will be better understood from the following description considered in connection with the accompany ing drawings, in which the corresponding reference numerals are utilized to identify the same elements and components throughout the various views.

DESCRIPTION OF THE PREFERRED EMBODIMENTS

Figures 1, 4, 5:
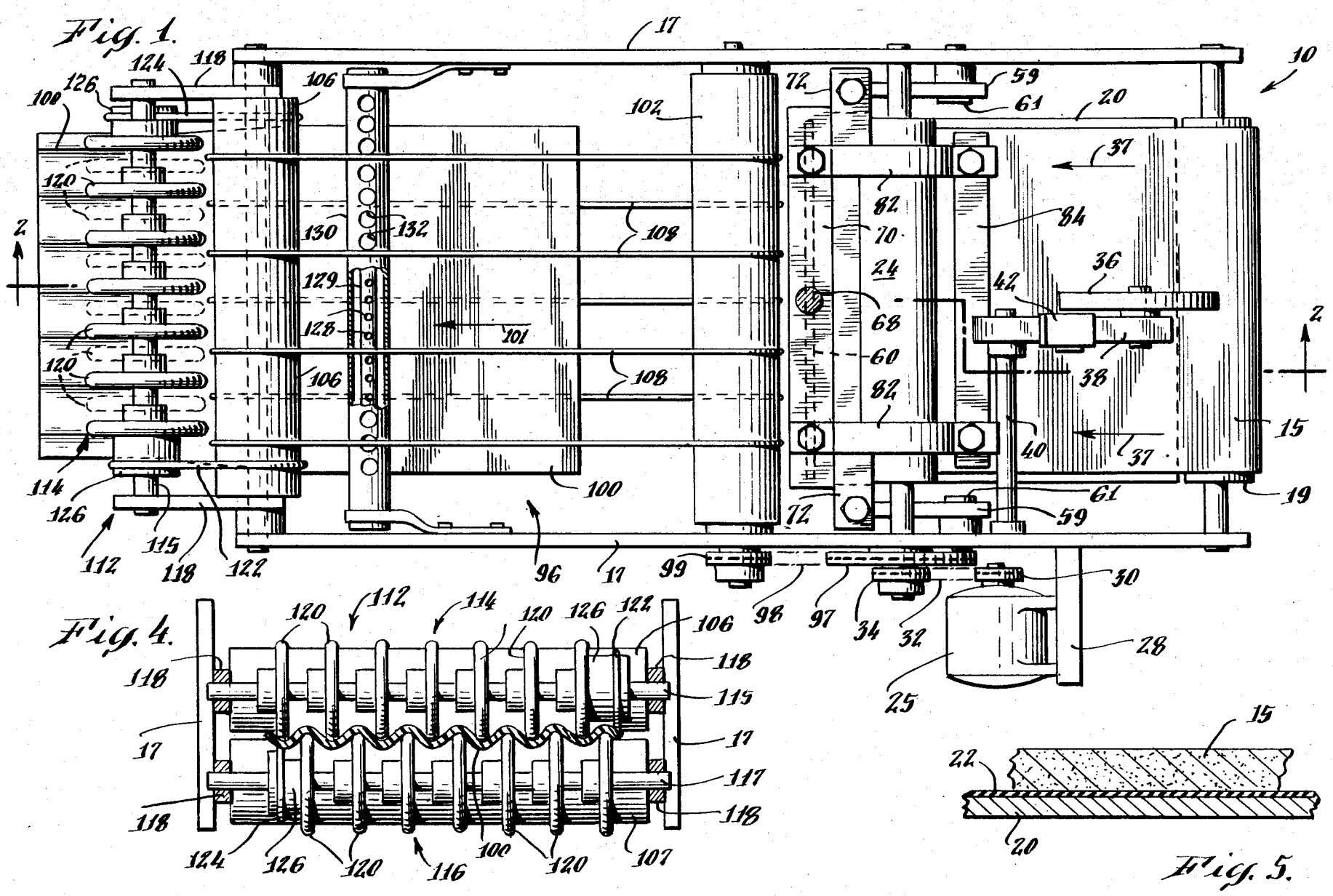
FIG. 1 is a top plan view of a machine for automatically cutting a web of foam material into sheets and for automatically dispensing the cut sheets, in accordance with the present invention.
FIG. 4 is a cross-sectional view taken along line 4—4 of FIG. 3.
FIG. 5 is an enlarged partial cross-sectional view taken along line 5—5 of FIG. 2.
Figures 2, 3:
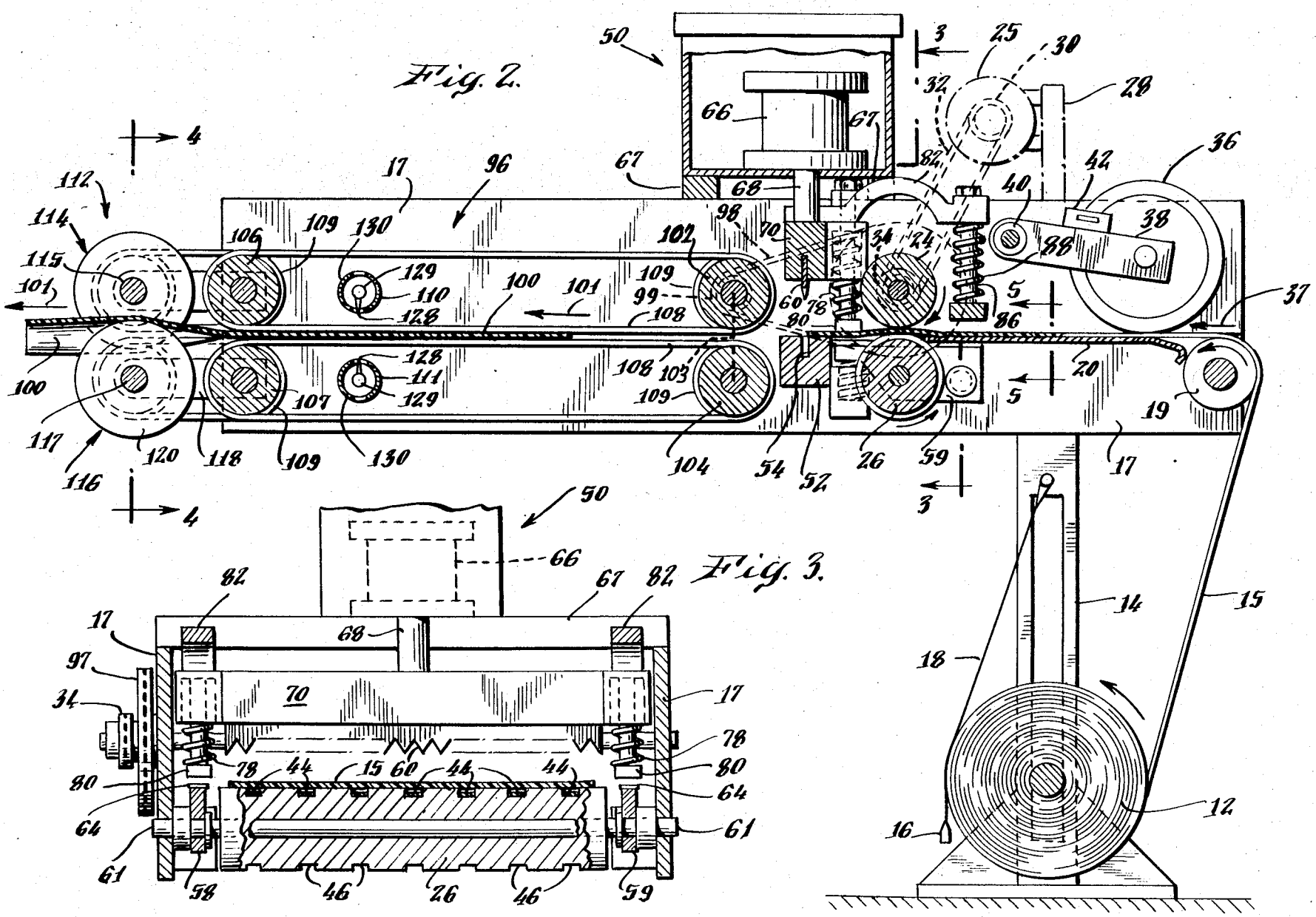
FIG. 2 is an elevational, longitudinal sectional view taken along the line 2—2 of FIG. 1, extending generally along the length of this machine.
FIG. 3 is a cross-sectional view taken along line 3—3 of FIG. 2.

Referring now to FIGS. 1 and 2, a machine for automatically cutting a web of foam material into sheets of predetermined length and for dispensing those sheets is referred to generally by the reference numeral 10. As will best be seen in FIG. 2, a supply roll of foam material 12 is mounted on a stand 14 attached to the machine frame 17, and this supply roll 12 is adapted to be unrolled in the form of a long web 15. A weight 16 is suspended from a canvas strap 18 which is draped over the periphery of the roll 12. This weight and strap 16, 18 serve as a friction drag acting on the periphery of the supply roll 12 for keeping slack out of the web 15 as the web is drawn from the roll and also for immediately stopping the roll 12, whenever the drawing action is stopped. The web 15 is passed over idler roller 19 leading onto a table or plate 20, preferrably of aluminum or steel, having a low-friction coating 22 as is best illustrated in FIG. 5 on which the web 15 is adapted to slide.

The web 15 is pulled from the roll 12 over the idler roller 19 and is drawn across the low-friction coating 22 of the table 20 by an upper draw roller 24 and by an opposed lower grooved draw roller 26. A motor drive 25 mounted on a motor drive support 28 turns a drive sprocket 30 which carries a chain or timing belt 32 coupled to a driven sprocket 34 which is connected to the shaft of the upper draw roll 24, thereby continuously rotating this upper roll.

A measuring wheel 36 is rotatably mounted on an arm 38 having a pivot mount 40 so that the rim of this wheel rests on the foam web 15 over the table 20. The measuring wheel has an associated counter 42 which counts the number of revolutions of the measuring wheel. For example, this counter 42 responds to the passage of one or more small permanent magnets affixed to the wheel 36 so that these magnets pass by the counter 42 as the wheel is turned by travel 37 of the web 15. This counter is connected to a control circuit (not shown) which can be set up so that the length of the material 15 to be cut can be predetermined in accordance with the setting. When the proper web length has been drawn a switch in the control circuit (not shown) actuates a cutter station 50, to be described later.

Figure 6:
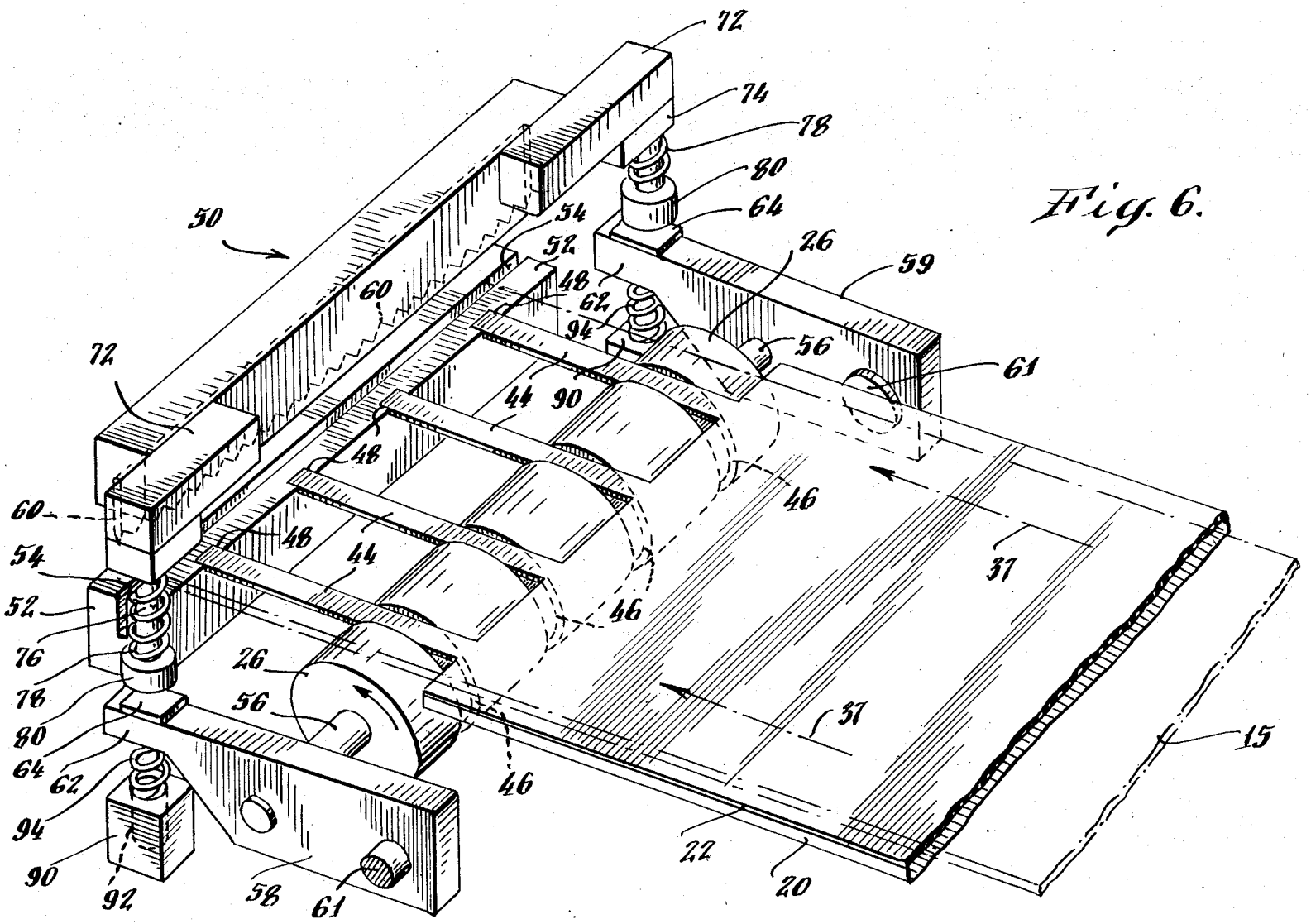
FIG. 6 is a perspective view of the lower draw roller feeding a web of foam material along the low-friction table surface to a cutting station, with the upper feed roller and remaining structure removed.

As will best be seen in FIG. 6, the low-friction coated table 20 has a plurality of bridge-like fingers or strips 44 which extend downstream from this low-friction coated table or plate 20. For example, the low-friction coating 22 is Teflon ptfe slippery plastic. These bridge fingers 44 extend through clearance grooves 46 in the movable grooved lower draw roll 26, and the downstream ends of these bridge fingers are received and seated in notches 48 in the top surface of a fixed anvil 52 located in the cutter station 50. This stationary anvil 52 contains a knife clearance groove 54 for receiving a cut-off knife blade 60 when the blade is moved down in the manner to be described later.

Figure 8:
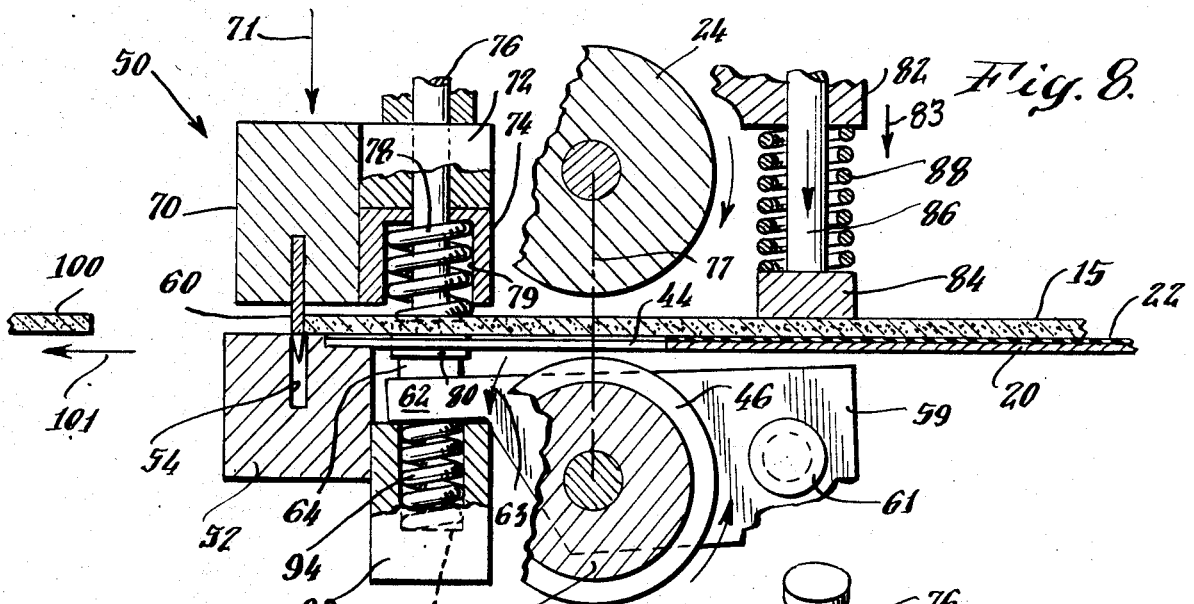
FIG. 8 is a view similar to FIG. 7 illustrating the cutting of the web into a sheet, with the draw rollers momentarily displaced away from the web and the web momentarily being clamped to the table surface during the cutting action.

For clarity of illustration, the perspective view in FIG. 6 only illustrates four of the bridge fingers 44 and four of the grooves 46. On the other hand, the sectional view in FIG. 3 illustrates seven of these bridge fingers 44 and seven of the grooves 46. The point of these various illustrations is that the number of such bridge fingers or strips (and corresponding number of grooves 46) is not critical so long as there are a sufficient number of the fingers 44 for adequate support of the foam web 15 to prevent undue sagging of the foam web during those moments when the lower draw roll 26 is moved down away from contact with the lower surface of the web 15 during cutting, as is shown in FIG. 8, and as will be explained in detail later.

As shown in FIG. 6, the lower feed roller 26 has an axle 56 which is mounted in a pair of pivot arms 58 and 59. Each of these pivot arms 58 and 59 has a forward projection 62 having a resilient rubber pad 64 on the top surface thereof on the downstream end of the pivot arm projection 62. The pivot arms 58 and 59 are each mounted on a fixed pivot 61 secured to the machine frame 17. By virtue of this pivot arm mounting 58, 59, the lower draw roll 26 can be swung down away from its normal contact with the lower surface of the web 15 as will be explained more fully later in connection with FIG. 8. This down-swing of the lower draw roll 26 momentarily interrupts the web drawing action 37 even though the two draw rolls 24, 26 are continuously rotating, as will be explained further later.

The cutter station 50, shown in FIGS. 2 and 3, includes an actuating pneumatic cylinder 66 having a piston rod 68. This cylinder 66 is actuated by an electrically operated solenoid valve (not shown) connected in the control circuit of the counter 42 in a conventional manner for cutting the web 15 in response to signals from the measuring wheel counter 42 when the proper length of the web 15 has been measured.

Figure 9:
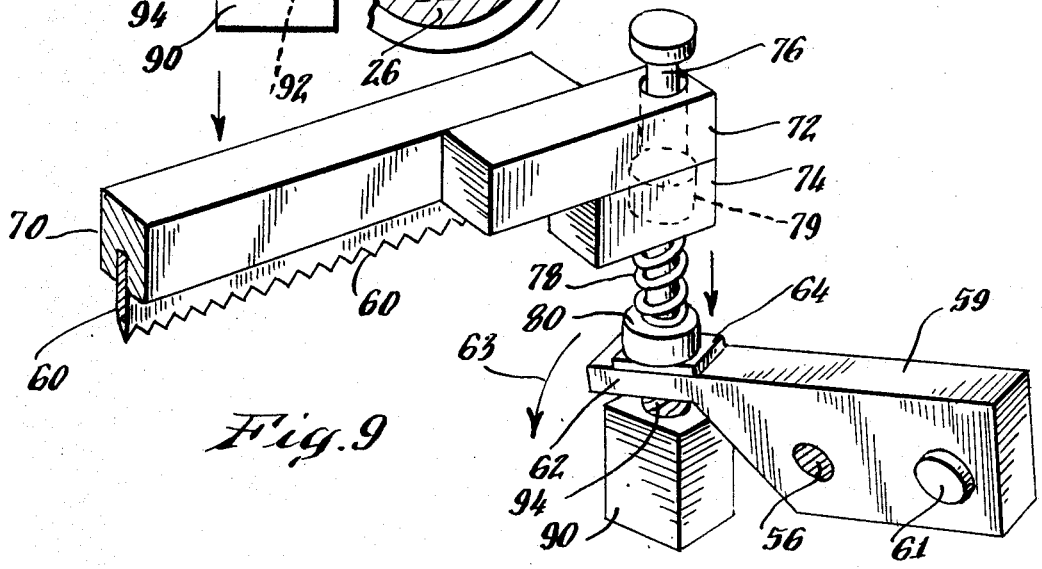
FIG. 9 is an enlarged perspective view of the structure utilized to move the lower draw roller down away from contact with the web as it is being cut in FIG. 8.

The pneumatic cylinder 66 is mounted on transverse frame members 67 which span above the foam web 15. The piston rod 68 carries a movable knife bar 70 which has the serrated knife blade 60 mounted therein and projecting down below the knife bar 70. As best shown in FIGS. 6 and 9, a pair of presser foot bars 72 are mounted on opposite ends of the knife bar 70. Each presser foot bar 72 carries a socket block 74, with a movable presser foot vertical rod 76 extending therethrough and terminating in a presser foot 80. A presser foot spring 78 is positioned encircling the presser foot vertical rod 76 between the socket block 74 and the presser foot 80. The vertical rod 76 is movable with respect to the bar and socket block 72, 74, and the spring 78 urges this rod downwardly. The upper end of this spring 78 is seated in a socket 79 in the block 74.

In order to clamp the web 15 during cutting, there is a clamp bar 84 (FIGS. 1, 2, 7 and 8). For operating this clamp bar 84 the knife bar 70 also has mounted thereon a pair of clamp carriers 82 having the clamp bar 84 movably mounted thereto by a pair of clamp rods 86 each of which carries an encircling clamp spring 88 positioned between the clamp carrier 82 and the clamp bar 84. (See FIGS. 2, 7 and 8). By comparing FIG. 8 with FIG. 7, it will be understood that each clamp bar rod 86 is vertically slidable relative to the clamp carrier 82. Thus, when the carrier 82 is moved down as is indicated by the arrow 83, into the clamping position, the carrier 82 can move down relative to the clamp bar 84 for compressing the spring 88 to exert the desired clamping force against the foam web 15 resting on the table 20, 22.

Returning to FIG. 6 there is a stop 90, having a socket 92 therein for holding an arm-lift spring 94, positioned under each pivot arm projection 62 in alignment with the respective presser feet 80.

Figure 7:
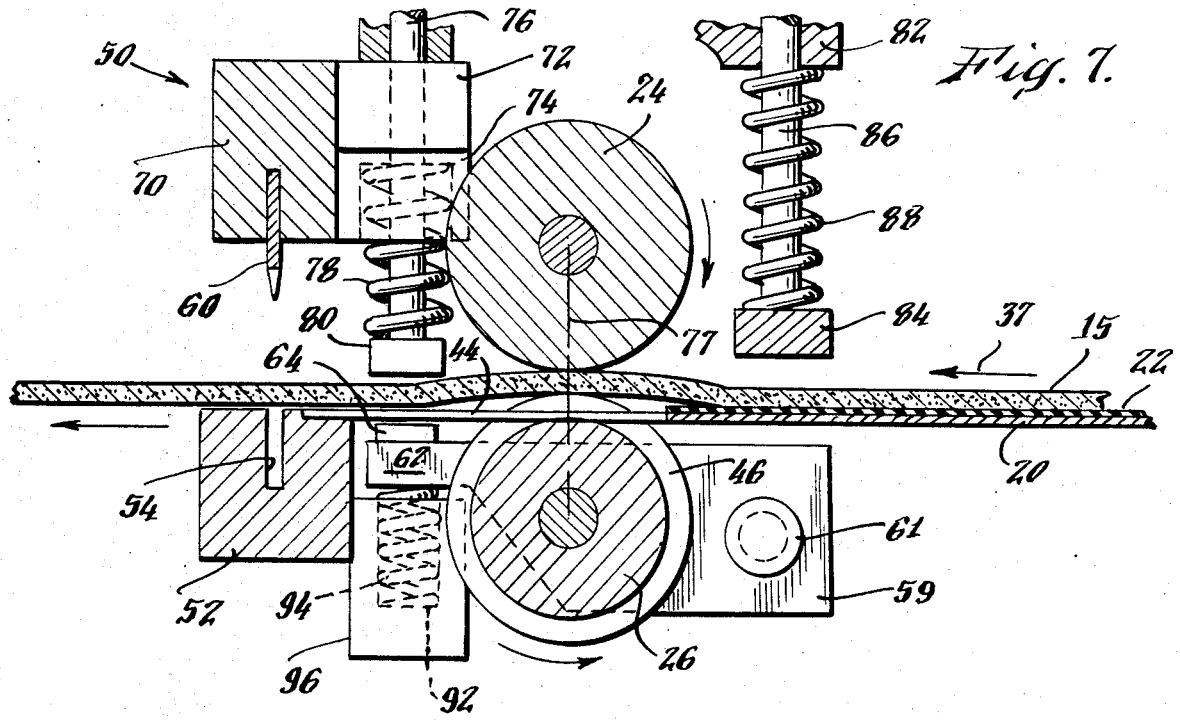
FIG. 7 is an enlarged side elevational view of selected portions of the cutting station partially in cross-section, illustrating the web of foam material being fed by the draw rollers to the cutting station.

The operation of the machine 10 which has been partially described along with the structure to this point will now be further explained. It is to be noted in FIG. 6 that the very top of the grooved roll 16 normally extends slightly above the level of the bridge fingers 44. Accordingly, as the web 15 is passed over this roll 26 the web is lifted slightly (as shown in FIG. 7) away from the top surface of the bridge fingers 44, thus being lifted into contact with the continuously rotating upper draw roll 24, which is continuously rotated by the drive supplied from the motor 25. It is also noted that the lower grooved draw roll 26 is continuously being rotated by being geared to the shaft of the upper draw roll 24, as is shown by the dashed line 27 in FIGS. 7 and 8.

The gears which provide the continuous drive 27 have sufficiently long teeth for remaining in engagement when the lower roll 26 is moved down (as shown in FIG. 8). Consequently, the continuously rotating draw rolls 24, 26 can produce drawing motion 37 for the web 15 only when the web is lifted up against the upper roll 24 by this continuously rotating lower grooved roll 26, as shown in FIG. 7.

During the feeding 37, the web is lifted into gripping contact between the continuously rotating draw rolls 24, 26, and accordingly the web 15 is pulled from the supply roll 12 over the idler roller 19 and is slid along the low-friction surface 22 of the table 20 until a predetermined length has been measured by the measuring wheel 36, at which time the pneumatic cylinder 66 is actuated in the cutter station 50. Actuation of this air cylinder 66 causes the knife bar 70 to descend, as shown by the arrow 71 in FIG. 8, carrying with it the presser foot bars 72 as well as the two clamp carriers 82. The clamp bar 84 extends (as shown in FIG. 1) across the width of the foam web 15, and it initially is spaced above this web 15, as is shown in FIGS. 2 and 7.

FIG. 7 illustrates the raised position of the clamp bar 84 and the raised position of one of the presser feet 80 as the web is being pulled (arrow 37) through the cutting station 50. This pulling feeding of the web 15 occurs during the time periods when the cylinder 66 at that cutting station is in its inactivated state. Once the cylinder 66 has been actuated as a result of the action of the measuring counter, each of the presser feet 80 (which are positioned beyond the opposite edges of the web 15) comes down upon the respective rubber pad 64 mounted on the pivot arm extension 62. The presser foot springs 78 are more forceful than the arm-lift spring 94 mounted in the stops 90. These arm-lift springs normally lift the pivot arms 58, 59 upwardly. Thus, the two presser feet 80 cause the two pivoted arms 58, 59 to swing down (arrow 63 in FIGS. 8 and 9) until their projections 62 rest upon the respective two fixed stops 90, (as illustrated in FIGS. 8 and 9.) As the pivoted arms 58, 59 swing down 63, the lower grooved feed roller 26 is caused to move down away from the foam material web 15. The bridge like fingers 44 remain stationary for supporting the web 15 when the lower feed roller 26 is depressed (FIG. 8). Thus, the lower grooved feed roller 26 is moved down away from the web 15, and the web now becomes momentarily supported by the bridge-like fingers. The web 15 is now momentarily down slightly away from being gripped between the rotating rolls 24, 26, and so the draw feed action is momentarily stopped.

The opposed feed rolls 24, 26 continue to be rotated by the drive 25, 27, but the draw action of the two rolls 24, 26 momentarily becomes ineffective, while the lower feed roll 26 is depressed down away from the lower surface of the web of foam material. There is no longer any gripping action between these two rotating feed rolls. As will be seen in FIG. 8, a clearance exists between the upper feed roll 24 and the web 15 when this lower feed roll swing-down action 63 takes place, with the foam material now being momentarily supported by the bridge fingers 44. After each pivoted arm 58 or 59 hits its respective stop 90, the presser foot 80 is stopped by the now immovable pivot arm 58 or 59. Then, the strong presser foot spring 78 becomes compressed as the knife bar 70 and the presser foot bars 72 continue to move down.

As shown in FIG. 9, the presser foot vertical rod 76 can slide relative to the presser foot bar 72, thereby allowing the knife bar 70 to continue moving down for now causing the clamp bar 84 (as shown in FIG. 8) to arrest the motion of the web. The two clamp bar springs 78 and the two vertical clamp slide rods allow the clamp bar 84 to stop moving when it clamps the web 15 while the knife bar 70 continues to move down. As is seen in FIG. 8, the knife blade 70 thereafter moves farther down to cut the foam web 15 as the blade 60 enters partially into the anvil clearance groove 54.

In summary, three advantageous functions are achieved in sequence during and by the single downward motion 71 of the knife bar 70:

1. The draw roll feed action 37 is briefly interrupted by swing-down travel 63 (FIGS. 8 and 9) of the lower draw roll 26.

(a) The stronger presser foot springs 78 overcome the weaker lift-arm springs 94 to cause the swing-down travel 63.

(b) The presser foot springs 78 and slide rods 76 now allow the knife bar 70 to continue moving down 71, even though the swing-down travel has been stopped by bottoming of the arm projections 62 against the stops 90.

(c) The lower draw roll rotating drive 77 remains in effect for keeping the lower draw roll 26 continuously rotating during swing-down 63.

2. This continuing downward motion 71 of the knife bar 70 now causes the downwardly carried 83 clamp bar 84 to clamp the foam web 15 firmly against the table 20, 22 (FIG. 8) for holding the web stationary during cut off and sheet take-away, such take-away to be explained further below.

(a) The clamp bar springs 88 and slide rods 86 now allow the knife bar 70 to continue moving down 71 (and allow the clamp bar carriers 82 to continue moving down 83) even though the clamp bar 84 has been stopped by clamping engagement against the foam web 15 upon the table 20, 22.

3. This continuing downward motion 71 of the knife bar 70 now causes the serrated or saw-tooth configured foam cutting blade 60 to enter the groove 54 in the anvil 52 for cutting a sheet 100 of predetermined length from the end of the foam web as the web is held stationary by the clamp bar 84.

4. The cut sheet 100 is taken away 101 by a downstream conveyor to be described and explained.

(a) The downstream take-away conveyor 96 is continuously travelling at a much faster rate of speed than the feed rate 37 of the draw rollers 24, 26 so that the cut sheet 100 is conveyed away 101 at a fast rate for reasons to be explained below.

Downstream of the cutting station is a "floating-action" conveyor 96 driven by a chain or timing belt drive 98 coupled by a drive sprocket 97 (FIGS. 1 and 3) to the continuously rotating shaft of the upper draw roll 24. This drive chain or timing belt 98 passes around a driven sprocket 99 (FIGS. 1 and 2) connected to the shaft of an upstream upper conveyor roller 102 (FIG. 2). Upstream conveyor rolls 102, 104 (FIG. 2) and downstream upper and lower rollers 106, 107 intercoupled by belts 108 form the conveyor system 96. Static eliminators 110, 111 are provided for removing static electrical charges from the cut sheet 100 as the cut sheet 100 moves to a longitudinal corrugating station 112 best illustrated in FIG. 4 in which the cut sheet 100 is passed through staggered corrugating upper and lower rollers 114 and 116, respectively, for reasons to be explained further below.

Inviting attention again to the "floating-action" conveyor 96, FIG. 1 shows that the multiple conveyor belts 108 are narrow, for example each of these belts 108 has a circular cross section. These belts 108 run in grooves 109 (FIG. 2) in the respective pairs of upstream and downstream rollers 102–106 and 104–107. Moreover, these belts 108 are relatively widely spaced, and they are staggered in upper and lower positions. For example, there may be four or five lower conveyor belts 108 and three or four upper conveyor belts 108, with the upper belts intervening (alternating) in lateral position with respect to the lower belts. Thus, the cut sheet 100 rests lightly in generally "floating" relationship between these lower and upper conveyor belts 108, and the cut sheet 100 is not being positively gripped between them.

It is to be noted that the drive sprocket 97 (FIGS. 1 and 3) for the conveyor drive chain 98 is considerably larger in diameter than the driven sprocket 99, for example, the ratio of their diameters is three-to-one. The lower upstream conveyor roller 104 is geared directly to the upper upstream conveyor roller 102 as indicated by the dashed line 103 indicating a direct mechanical drive so that all of the conveyor belts 108 are travelling at the same rate of speed.

By virtue of this 3-to-1 diameter ratio of the conveyor drive sprockets 97/99, the conveyor belts 108 are continuously travelling at a much faster speed than the surfaces of the draw feed rolls 24, 26, in this example travelling three times as fast. However, so long as these draw feed rolls 24, 26 are in gripping relationship with the foam web 15 (FIG. 7) the gripping action of these rolls 24, 26 is the dominant factor, because the downstream end of the foam web 15 is merely "floating" gently supported between the multiple lower and upper fast-travelling conveyor belts 108. In other words, these fast-travelling conveyor belts 108 are sliding past the slower moving downstream end of the foam web 15 without exerting hardly any force on the foam web.

When the clamp bar 84 clamps the foam web 15 as shown in FIG. 8, the fast-travelling conveyor belts 108 continue to slide past the downstream end of the foam web.

Then, as soon as the knife blade 60 has cut off the sheet 100, this sheet becomes free to be propelled downstream 101 at fast speed as conveyed by the fast-travelling belts 108.

As seen in FIGS. 1 and 2 the shafts 115, 117 of the upper and lower corrugating rolls 114, 116 are journaled in frame member 118 projecting downstream from the end of the main frame 17 so that a cut sheet 100 which is propelled rapidly downstream by the conveyor 96 will pass between the rounded rims of the multiple wheels 120 mounted on these respective shafts 115, 117 in staggered (alternating) positions. Consequently, the fast-travelling 101 foam sheet 100 now becomes temporarily longitudinally corrugated (bent up and down in a transverse direction as seen in FIG. 4). This longitudinal corrugation imparts a modest amount of longitudinal rigidity and longitudinal stability to the fast-travelling 101 foam sheet as this sheet is propelled from between the rounded perimeters of the corrugating wheels 120. Thus, the ejected sheet 100 is capable of flying as a projectile through the air for a few feet to land in a predetermined place of utility, for example to land in the open top of a box packed with fragile articles such as fruit, being conveyed past the downstream end of the discharge conveyor 96.

In order to rotate the shafts 115, 117 of the corrugating rolls 114, 116, there are upper and lower drive belts 122, 124, respectively, running in grooves in the upper and lower downstream conveyor rolls 106, 107 and running around pulleys 126 mounted on the respective shafts 115, 117. In order to launch (eject) the corrugated sheet 100 at relatively high velocity 101, the corrugating wheels 120 have somewhat larger diameter than the respective downstream conveyor rolls 106, 107, and the driven pulleys 126 are somewhat smaller in diameter than their drive rolls 106, 107. Thus, the rounded rims of the wheels 120 are travelling faster than the conveyor belts 108, for example the rim speed of the wheels 120 is in the range from 6% to 40% faster than the conveyor belts 108.

The static eliminators 110, 111 include numerous sharp pointed pins 128 aimed at the passing sheet 100 and aligned in a row on a high voltage rod 129 extending across the width of the machine. To protect from inadvertent contact, there is a shroud tube 130 encircling each rod 129 with ports 132 aligned with the respective pins 128.

Immediately after the sheet 100 has been cut off from the web 15 at the cutting station 50, and while this sheet is being taken away 101, the piston rod 68 (FIG. 1) is retracted for quickly raising the knife bar 70. As this knife bar 70 is being raised, the previously described rapid sequence of actions is reversed, namely, the clamp bar 84 is raised for unclamping the web 15, and then the lower draw roll 26 is raised back into its initial elevated position (FIG. 7) for again gripping the web between the continuously rotating drive rolls 24, 26 for feeding the next metered length of web through the cutting station for repeating the cycle.

It will be understood that the corrugating station 112 is useful in certain types of packaging operations such as the packaging of fruit and other fragile and/or perishable items which are desired to be separated and spaced in the packaging arrangement. As the cut corrugated sheets are dispensed being launched downstream from the corrugating station 112 the ejected cut sheets 100 may be directed so as to land into the boxes being packed.

The method and apparatus herein described provide a quick, efficient method of metering and then cutting the cut sheets into their desired length in a rapid, efficient manner for a foam material which is often considered difficult to handle. There is provided a non-complex and relatively inexpensive method and apparatus for quickly sequentially conveniently (1) interrupting the pulling feeding force on the web, (2) clamping the web, (3) cutting the sheet from the web, (4) rapidly taking away the cut sheet, and (5) launching (ejecting) the cut sheet endwise through the air into a placement position of utility. This method and apparatus eliminates the problem and the cost of unpacking pre-cut sheets for use in a packaging operation.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and reasonable equivalents of the claimed elements.

What is claimed is:

1. The method of automatically cutting a web of foam material into sheets of predetermined length and of automatically dispensing the cut sheets comprising the steps of:

feeding the web of foam material along a path in a direction from upstream to downstream through a cutting station by gripping the web between a pair of opposed feed rolls, continuously rotating at least one of said feed rolls, metering the length of web passing through the cutting station, when a predetermined desired length of web has been fed downstream past the cutting station performing the following actions in rapid sequence, the first three of which are performed by a single drive stroke in a first direction:

(1) by a first portion of said drive stroke increasing the spacing between the pair of feed rolls for briefly interrupting their feed action on the web in spite of the continuong rotation of at least one of the feed rolls, (2) by an intermediate portion of the drive stroke clamping the web for stopping the web at a location upstream of the cutting station and upstream of said feed rolls, (3) by a final portion of the drive stroke cutting the stationary web, (4) taking the resulting cut sheet downstream away from the cutting station, (5) dispensing the cut sheet, (6) by an intermediate portion of the drive stroke in a second direction unclamping the web, (7) by a final portion of the drive stroke in said second direction reducing the spacing between the feed rolls for again gripping the web for feeding another length of the web along the path from upstream to downstream through the cutting station for repeating the sequence of operations.

2. The method as claimed in claim 1, wherein:

the resulting cut sheet is propelled downstream from the cutting station by continuously moving upper and lower conveyor belts which support in non-gripping "floating" relationship the portion of the web between them which has been fed downstream through the cutting station, these conveyor belts are continuously travelling at a faster rate of surface speed than the surface speed of the continuously rotating feed roll, these faster-travelling, non-gripping conveyor belts continuously slide past the downstream portion of the web between them while said downstream portion of the web is connected to the web upstream of the cutting station, and these faster-travelling, non-gripping conveyor belts immediately propel said downstream portion of the web in the downstream direction away from the cutting station upon separation of said downstrean portion from the web by cutting occurring at said cutting station.

3. The method as claimed in claim 2, wherein:

the cut sheet is dispensed from between the downstream ends of the continuously moving upper and lower conveyor belts by the steps of:

longitudinally corrugating the sheet while it is exiting from between the conveyor belts, and ejecting the longitudinally corrugated sheet for flying through the air to a desired position of utility.

4. The method as claimed in claim 2, in which:

said upper and lower faster-travelling, non-gripping-conveyor belts are continuously travelling at a much faster speed than the surface speed of the continuously rotating feed roll.

5. The method as claimed in claim 2, in which:

said upper and lower faster-travelling, non-gripping conveyor belts are travelling about three times as fast as the surface speed of the continuously rotating feed roll.

6. Apparatus for automatically cutting a foam material web into sheets of predetermined length and for automatically dispensing the cut sheets comprising:

a table for receiving a foam material web which is to be cut in sheets, a cutter station having a movable cutter bar carrying a cutter, upper and lower feed rollers positioned downstream from said table for contacting said web positioned therebetween for feeding said web in a downstream direction to said cutter station after the web has been slid along said table by said feed rollers, said cutter station being downstream from said feed rollers, stroke drive means in said cutter station connected to said cutter bar for moving said cutter bar in a cutting stroke, web feed interrupting means moved by said stroke drive means during a first portion of said cutting stroke for actuating a displacement movement of one of said rollers away from said web for briefly interrupting the feed action while a clamping and cutting of said web takes place, clamp means positioned upstream positioned upstream of said feed rollers and being moved by said stroke drive means during a second portion of said cutting stroke for clamping said web for preventing movement of said web after said displacement movement of said roller, said stroke drive means moving said cutter through said web during a third portion of said cutting stroke for cutting sheets from said web while said clamp means having been moved by said stroke drive means clamps said web, said stroke drive means having a return stroke, said stroke drive meeans during a first portion of said return stroke moving said cutter away from said web, said stroke drive means during a second portion of said return stroke removing said clamp means from clamping said web, said stroke drive means during a third portion of said return stroke returning the displaced roller into gripping contact with said web for again feeding the web after a sheet has been cut, and take-away means positioned downstream from said cutter station for removing cut sheets from said cutter station after they have been cut from said web.

7. The apparatus as claimed in claim 6, having:

a motor drive coupled to one of said feed rollers for continuously rotating at least one of said feed rollers at a predetermined surface speed for moving said web through said cutter station, said take away means having a drive roller coupled to said motor drive for providing continous movement of said take away means in non-gripping "floating" relationship with a portion of the foam web extending downstream from said cutter station, said take away means continously moving in a downstream direction away from said cutter station at a rate of speed faster than said predetermined surface speed of said feed roller for causing said take away means to slide past the portion of the web extending downstream from said cutter station, said portion of the web extending downstream from the cutter station becoming a cut sheet upon said cutter moving through the web, and said take away means propelling the resulting cut sheet downstream away from the cutter station at a faster rate of speed than said predetermined surface speed of said feed roller.

8. The apparatus as claimed in claim 6, having:

a corrugating station positioned at the downstream end of said take away means, said corrugating station having staggered corrugating rollers for receiving the cut sheets therebetween and thereby longitudinally corrugating such sheets for imparting longitudinal stiffness to the cut sheets, said staggered corrugating rollers having peripheral surfaces moving at a faster rate of speed than said take away means for projecting such longitudinally corrugated cut sheets through the air toward a desired position.

9. Apparatus as claimed in claim 8, in which:

said corrugating rollers have peripheral surfaces moving faster than said take away means at a rate in the range from 6% to 40% faster.

10. The method of automatically cutting a web of foam material into sheets of predetermined length and of automatically dispensing the cut sheets comprising the steps of:

feeding the web of foam material along a path through a cutting station by gripping the web between a pair of opposed feed rolls, continuously rotating at least one of said feed rolls, metering the length of web passing through the cutting station, when a predetermined desired length of web has been fed downstream past the cutting station performing the following actions in rapid sequence:

(1) increasing the spacing between the pair of feed rolls for briefly interrupting their feed action on the web in spite of the continuing rotation of at least one of the feed rolls, (2) clamping the web, (3) cutting the web, (4) taking the resulting cut sheet downstream away from the cutting station, (5) dispensing the cut sheet, (6) unclamping the web, (7) reducing the spacing between the feed rolls for again gripping the web for feeding another length of the web along the path through the cutting station for repeating the sequence of operations, and said rapid sequence of actions being produced by the steps of:

spring biasing one of the feed rolls toward the other feed roll for normally gripping the web between them for feeding the web, moving a cutter in the cutting station by a predetermined cutter stroke for cutting the web, connecting a movable element to the cutter for causing the element to move during the cutter stroke, using the movable element for overcoming the feed roll spring bias for moving the spring-biased roll away from its web-gripping feeding position during the cutter stroke, also connecting a web clamp to the cutter through a spring for causing the clamp to move into a web-clamping position during the cutter stroke, and arranging the spring to apply web-clamping force to the clamp for allowing the cutter to continue to move to completion of its predetermined stroke after the clamp has been moved to its web-clamping position.

11. The method as claimed in claim 10, including the steps of:

connecting said movable element to the cutter through another spring which is stronger than the spring bias of the one feed roll, and arranging said other spring for overcoming the spring bias and for allowing the cutter to continue to move to completion of its predetermined cutter stroke after the movable element has moved the spring-biased roll away from its web-gripping feeding position.

12. Apparatus for automatically cutting a foam material web into sheets of predetermined length and for automatically dispensing the cut sheets comprising:

a table for receiving a foam material web which is to be cut in sheets, a cutter station having a movable bar carrying a cutter, upper and lower feed rollers positioned downstream from said table for contacting said web positioned therebetween for feeding said web to said cutter station after the web has been slid along said table by said feed rollers, means on said cutter bar for actuating a displacement movement of one of said rollers away from said web for briefly interrupting the feed action while the clamping and cutting of said web takes place, a clamp bar coupled to said cutter bar for movement therewith, means for actuating said cutter bar for moving said cutter through said web, for cutting sheets from said web, while said clamp bar having moved with said cutter bar clamps said web on said table, means for returning the displaced roller into gripping contact with said web for again feeding the web after a sheet has been cut, and take-away means for removing cut sheets from said cutter station after they have been cut from said web, said means on said cutter bar for actuating movement of said lower roller comprising presser foot means mounted for movement with said cutter bar, said one roller being mounted on pivot arm means in a position to be swung by said presser foot means for displacing the roll away from web-gripping relationship, whereby during the stroke of the cutter bar, said presser foot means swings said pivot arm means for displacing said one roller away from web-gripping contact with said web, while immediately said web is clamped by said clamp bar, and immediately the clamped web is cut by the cutter.

13. The apparatus as claimed in claim 12 wherein:

said pivot arm means has stop means in alignment with said presser foot means for limiting the swinging movement of said pivot arm means and therefore limiting the displacement movement of said one roller.

14. The apparatus as claimed in claim 13, wherein:

said stop means includes arm-lift spring means for urging said pivot arm means toward web-gripping position in which the one roller has not been displaced, said presser foot means when actuated overcoming the force of said arm-lift spring means to thereby swing said pivot arm means into displaced position.

* * * * *